US009672966B2

(12) United States Patent
Hayashi et al.

(10) Patent No.: US 9,672,966 B2
(45) Date of Patent: Jun. 6, 2017

(54) BOBBIN, WINDING APPARATUS AND COIL

(71) Applicant: DENSO CORPORATION, Kariya, Aichi-pref. (JP)

(72) Inventors: Mitsuyuki Hayashi, Kariya (JP); Akira Yamasaki, Kariya (JP); Masahiro Hayashi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 14/944,284

(22) Filed: Nov. 18, 2015

(65) Prior Publication Data

US 2016/0155553 A1 Jun. 2, 2016

(30) Foreign Application Priority Data

Dec. 1, 2014 (JP) ..... 2014-243192

(51) Int. Cl.

| | |
|---|---|
| ***H01F 5/02*** | (2006.01) |
| ***B65H 67/056*** | (2006.01) |
| ***B65H 75/14*** | (2006.01) |
| ***H01F 41/082*** | (2016.01) |

(52) U.S. Cl.

CPC ..... *H01F 5/02* (2013.01); *B65H 67/056* (2013.01); *B65H 75/146* (2013.01); *H01F 41/082* (2016.01); *H01F 2005/022* (2013.01)

(58) Field of Classification Search

CPC .... H01F 5/02; H01F 41/082; H01F 2005/022; B65H 75/146; B65H 67/056

See application file for complete search history.

(56) References Cited

U.S. PATENT DOCUMENTS

| | | | | |
|---|---|---|---|---|
| 3,661,342 A * | 5/1972 | Sears | H01F 5/02 | 242/118.41 |
| 4,638,282 A * | 1/1987 | Ellison | H01F 27/306 | 336/185 |
| 4,862,130 A * | 8/1989 | Ellison | H01F 5/02 | 336/185 |
| 5,332,989 A * | 7/1994 | Ching | H01F 5/02 | 242/118.41 |
| 5,523,733 A * | 6/1996 | Heritier-Best | H01F 5/02 | 242/433 |
| 5,754,086 A | 5/1998 | Ichida et al. | | |

FOREIGN PATENT DOCUMENTS

JP H06-231981 A 8/1994

* cited by examiner

*Primary Examiner* — Bernard Rojas

(74) *Attorney, Agent, or Firm* — Harness, Dickey & Pierce, P.L.C.

(57) ABSTRACT

A bobbin has a winding core and multiple partitioning walls, so that multiple winding areas are formed in an axial direction. A groove is formed in each of the partitioning walls, so that a wire rod strides over the partitioning wall bypassing through the groove when a winding process for one of the winding areas is finished and a winding process for a neighboring winding area will be started. The groove has a first and a second guide wall surfaces, which are opposed to each other in a circumferential direction. Each of the first and the second guide wall surfaces is inclined in the axial direction such that each of the first and the second guide wall surfaces comes closer to a circumferential winding-end side in the axial direction to a stride-end side.

8 Claims, 12 Drawing Sheets

COMPARISON EXAMPLE

BOBBIN, WINDING APPARATUS AND COIL

CROSS REFERENCE TO RELATED APPLICATION

This application is based on Japanese Patent Application No. 2014-243192 filed on Dec. 1, 2014, the disclosure of which is incorporated herein by reference.

FIELD OF TECHNOLOGY

The present disclosure relates to a split-winding type coil, a bobbin for the split-winding type coil and a winding apparatus therefor.

BACKGROUND

A bobbin, which has multiple partitioning walls formed on a winding core so as to divide a winding space into multiple winding sections, is known in the art as a bobbin for manufacturing a coil of a split-winding type.

For example, as disclosed in Japanese Patent Publication No. H06-231981, a groove is formed in the partitioning wall of the bobbin so that a wire rod strides over the groove from one of winding sections to a neighboring winding section. When the wire rod is wound in one of the winding sections by a predetermined winding turns, the wire rod passes through the groove formed in the partitioning wall to the neighboring winding section.

In a general winding apparatus for a coil, a wire rod is supplied to a bobbin, which is rotated at a high speed, so that the wire rod is wound on the bobbin.

However, in a case that the wire rod is wound on the bobbin for the split-winding type coil (for example, as disclosed in the above Japanese Patent Publication No. H06-231981), the wire rod cannot surely pass through the groove formed in the partitioning wall when the bobbin is rotated at the high speed. In view of this point, in the winding apparatus of the prior art, the rotational speed of the bobbin is decreased to almost zero in order that the wire rod can pass through the groove. However, in such a winding process, it is necessary to repeat a decrease (the decrease to almost zero) and increase of the rotational speed of the bobbin each time when the wire rod passes through the groove. It requires a lot of time until the wire rod is wound on the bobbin for all of its winding sections.

SUMMARY OF THE DISCLOSURE

The present disclosure is made in view of the above problem. It is an object of the present disclosure to provide a bobbin for a split-winding type coil, a winding apparatus therefor and the split-winding type coil itself, according to which a wire rod can be wound on the bobbin in a shorter time.

According to one of features of the present disclosure, a bobbin for a split-winding type coil comprises:

a winding core on which a wire rod is wound in a circumferential direction of the winding core;

multiple partitioning walls formed at an outer peripheral surface of the winding core in such a manner that each of the partitioning walls extends in a radial-outward direction, the partitioning walls being arranged in an axial direction of the winding core so as to define multiple winding areas arranged in the axial direction of the winding core; and a groove formed in each of the partitioning walls, through which the wire rod passes from one of the winding areas to a neighboring winding area.

The groove has a first guide wall surface and a second guide wall surface, which are opposed to each other in the circumferential direction. Each of the first and the second guide wall surfaces is inclined in the axial direction such that each of the first and the second guide wall surfaces comes closer to a winding-end side of the circumferential direction in the axial direction to a stride-end side.

When the wire rod is wound on the bobbin, the wire rod is moved relative to the winding core in the circumferential direction of the winding core from one circumferential side to the other circumferential side as well as in the axial direction of the winding core from its one axial side to the other axial side, in order that a coil segment having multiple coil layers is formed in each of the winding areas. When the winding process for one coil segment is finished in one of the winding areas, the wire rod is moved from the one winding area to a neighboring winding area through the groove formed in the partitioning wall.

According to the above features, the first and the second guide wall surfaces are opposed to each other in the circumferential direction and each of the guide wall surfaces extends along a wire-rod moving direction. As a result, the wire rod is guided by the first guide wall surface in an inside direction of the groove when the wire rod is moved along the first guide wall surface. Then, the wire rod is further guided by the second guide wall surface in an outside direction of the groove when the wire rod is moved along the second guide wall surface. As above, the wire rod can surely pass through the groove.

According to the above features, the wire rod can pass through the groove even when the bobbin is rotated at a high speed during a winding operation of the wire rod on the bobbin. In other words, it is not necessary to decrease the rotational speed of the bobbin to almost zero in order that the wire rod passes through the groove. It is, therefore, possible in the present disclosure to reduce the time for winding the wire rod on the bobbin for all of the winding areas.

In the present disclosure, the high speed corresponds to a value higher than 10,000 rpm. However, the present disclosure is not limited to such high speed.

A winding apparatus according to the present disclosure is an apparatus for winding the wire rod on the bobbin of the split-winding type and comprises;

a holding portion for holding the bobbin and rotating together with the bobbin;

a nozzle portion for supplying the wire rod to the bobbin and movable in the axial direction relative to the bobbin; and a control unit for controlling a movement of the nozzle portion.

The control unit controls the nozzle portion in such a manner that a moving speed of the nozzle portion is accelerated and then decelerated when the nozzle portion moves in the axial direction from a first predetermined position to a second predetermined position, during a period in which the bobbin is rotated by one revolution, when the wire rod passes through the groove from one of the winding areas to the neighboring winding area. Each of the first and the second predetermined positions is located at a position above the partitioning wall.

According to the above winding apparatus, the wire rod can surely and smoothly pass through the groove formed in the partitioning wall, when the wire rod is wound on the bobbin.

According to another feature of the present disclosure, the split-winding type coil is composed of the above bobbin and the wire rod wound on the bobbin for each of the winding areas.

BRIEF DESCRIPTION OF THE DRAWINGS

The above and other objects, features and advantages of the present disclosure will become more apparent from the following detailed description made with reference to the accompanying drawings. In the drawings:

FIG. 6 is a view for explaining respective positions of a wire rod and a nozzle portion with respect to the bobbin;

DETAILED DESCRIPTION OF THE EMBODIMENTS

Figure 1:
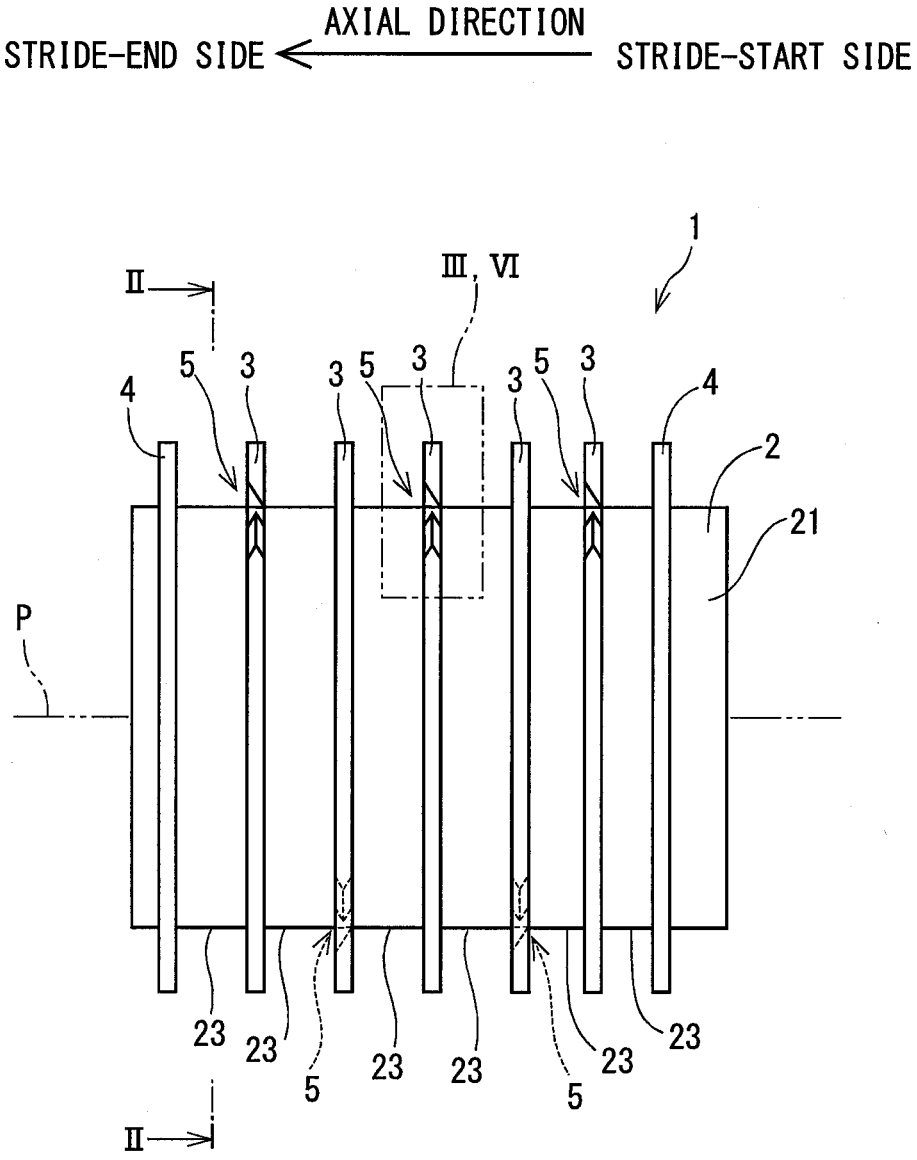
FIG. 1 is a schematic plane view showing a bobbin for a split-winding type coil according to a first embodiment of the present disclosure.

The present disclosure will be explained hereinafter by way of multiple embodiments and/or modifications with reference to the drawings. The same reference numerals are given to the same or similar structure and/or portion throughout the multiple embodiments in order to avoid repeated explanation.

First Embodiment (Bobbin Structure)

A structure of a bobbin 1 according to a first embodiment of the present disclosure will be explained at first with reference to FIGS. 1 and 2. The bobbin 1 is a component for a coil of a split-winding type, in which a wire rod 6 (explained below) is wound on each of divided winding areas 23 so that the split-winding type coil is formed.

The bobbin 1 has a winding core 2 of a tubular shape and multiple partitioning walls 3 and 4, which are formed at an outer peripheral surface 21 of the winding core 2. The partitioning walls 3 and 4 are arranged in an axial direction of the winding core 2, wherein the partitioning walls at both axial ends of the winding core 2 are referred to as axial-end partitioning walls 4 (or the outside partitioning walls 4), while the remaining partitioning walls located between the axial-end partitioning walls 4 are referred to as inside partitioning walls 3. In the present application, a circumferential direction of the winding core 2 is simply referred to as the circumferential direction. An axial direction of the winding core 2 is simply referred to as the axial direction.

The partitioning walls 3 and 4 define multiple winding areas 23 on the outer peripheral surface 21. The winding areas 23 are arranged in the axial direction. A groove 5 of a V-shape is formed at an outer peripheral surface 31 of each inside partitioning wall 3, in such a way that the groove 5 is cut into the inside partitioning wall 3 until a forward end of the groove 5 reaches the outer peripheral surface 21 of the winding core 2. The groove 5 passes through the inside partitioning wall 3 in the axial direction, so that the wire rod 6 strides over the inside partitioning wall 3 from one of the winding areas 23 to the neighboring winding area 23.

A further detailed structure of the bobbin 1 will be explained with reference to FIG. 3. The wire rod 6 will be wound on the bobbin 1 in each of the winding areas 23. A lower side of FIG. 3 corresponds to a winding-start side including a winding-start point, from which the wire rod 6 is wound on the bobbin 1 in the circumferential direction. An upper side of FIG. 3 corresponds to a winding-end side including a winding-end portion, at which the winding of the wire rod 6 is ended. A right-hand side of FIG. 3 corresponds to a stride-start side, from which the wire rod 6 strides over the inside partitioning wall 3 through the groove 5 in the axial direction to the neighboring winding area 23. A left-hand side of FIG. 3 corresponds to a stride-end side.

Figure 2:
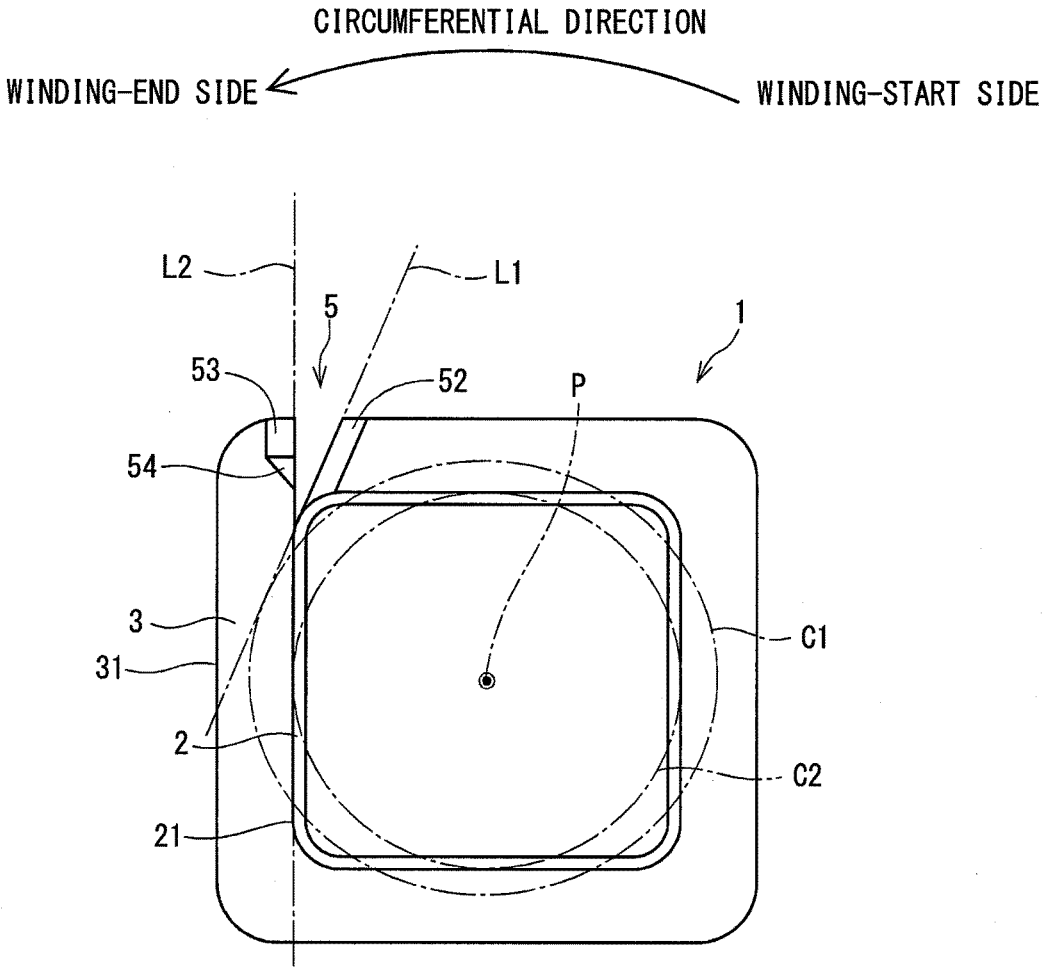
FIG. 2 is a schematic cross-sectional view, taken along a line II-II in FIG. 1, showing the bobbin of the first embodiment, wherein hatching lines for a cross-sectional surface are omitted for convenience sake.

As shown in FIG. 2, each of a first virtual circle C1 and a second virtual circle C2 has a center, which coincides with a center axis P of the winding core 2. A first tangential line L1 is a tangential line of the first virtual circle C1, while a second tangential line L2 is a tangential line of the second virtual circle C2. The first tangential line L1 and the second tangential line L2 intersect with each other at a point between the outer peripheral surface 21 of the winding core 2 and the outer peripheral surface 31 of the inside partitioning wall 3.

In the present embodiment, the winding core 2 has a cross section of an almost rectangular shape. The first tangential line L1 is in contact with a corner portion of the outer peripheral surface 21 of the winding core 2. The second tangential line L2 is in contact with a flat surface portion of the outer peripheral surface 21. In the present embodiment, the intersecting point between the first and the second tangential lines L1 and L2 is located on the outer peripheral surface 21 of the winding core 2.

The winding core 2 may be formed in a cylindrical shape having a circular cross section.

The inside partitioning wall 3 has multiple groove wall surfaces 51 to 55 forming the groove 5. The groove wall surfaces 51 and 52 are formed on the winding-start side, wherein the groove wall surface 51 is referred to as a first guide wall surface 51 and the groove wall surface 52 is referred to as a return prevention wall surface 52. The groove wall surfaces 53 to 55 are located on the winding-end side, wherein the groove wall surface 53 is referred to as a second guide wall surface 53, the groove wall surface 54 is referred to as a third guide wall surface 54, and the groove wall surface 55 is referred to as a side wall surface 55.

Each of the first guide wall surface 51 and the return prevention wall surface 52 extends along the first tangential line L1. The first guide wall surface 51 and the return prevention wall surface 52 are connected to each other at a middle portion of the inside partitioning wall 3 in the axial direction to forma V-shaped projection, which is projected in the circumferential direction toward the second and the third guide wall surfaces 53 and 54. More exactly, the first guide wall surface 51 is inclined with respect to the axial direction, in such a way that a point on the first guide wall surface 51 comes closer to the winding-end side in the circumferential direction (that is, to the second and the third guide wall surfaces 53 and 54) as the point further moves on the first guide wall surface 51 in the axial direction to the stride-end side. In a similar manner, the return prevention wall surface 52 is inclined with respect to the axial direction, so that a point of the return prevention wall surface 52 comes closer to the winding-start side (opposite to the second guide wall surface 53) as the point further moves on the return prevention wall surface 52 in the axial direction to the stride-end side.

It can be so reworded that the first guide wall surface 51 is inclined in the axial direction to the stride-end side and in the circumferential direction to the winding-end side. In a similar way, it can be so re-worded that the return prevention wall surface 52 is inclined in the axial direction to the stride-start side and in the circumferential direction to the winding-end side.

The second guide wall surface 53 extends along the second tangential line L2. The second guide wall surface 53 is inclined with respect to the axial direction, in such a way that a point on the second guide wall surface 53 comes closer to the winding-end side in the circumferential direction as the point further moves on the second guide wall surface 53 in the axial direction to the stride-end side. In other words, the second guide wall surface 53 is inclined in the axial direction to the stride-end side and in the circumferential direction to the winding-end side.

The third guide wall surface 54 is formed between the second guide wall surface 53 and the side wall surface 55. The third guide wall surface 54 is inclined with respect to the axial direction, in such a way that a point on the third guide wall surface 54 comes closer to the outer peripheral surface 21 of the winding core 2 as the point further moves on the third guide wall surface 54 in the axial direction to the stride-start side.

The side wall surface 55 extends along the second tangential line L2 and in the axial direction. The side wall surface 55 is connected to the outer peripheral surface 21 of the winding core 2 at a point equal to or close to the intersecting point between the first and the second tangential lines L1 and L2. A height of the side wall surface 55, that is, a distance between a lower end of the side wall surface 55 on a side to the outer peripheral surface 21 and an upper end of the side wall surface 55 on a side to the third guide wall surface 54, is preferably decided depending on a height of coil layers formed by the wire rod 6 wound on the bobbin 1 in each of the winding areas 23.

Figure 3:
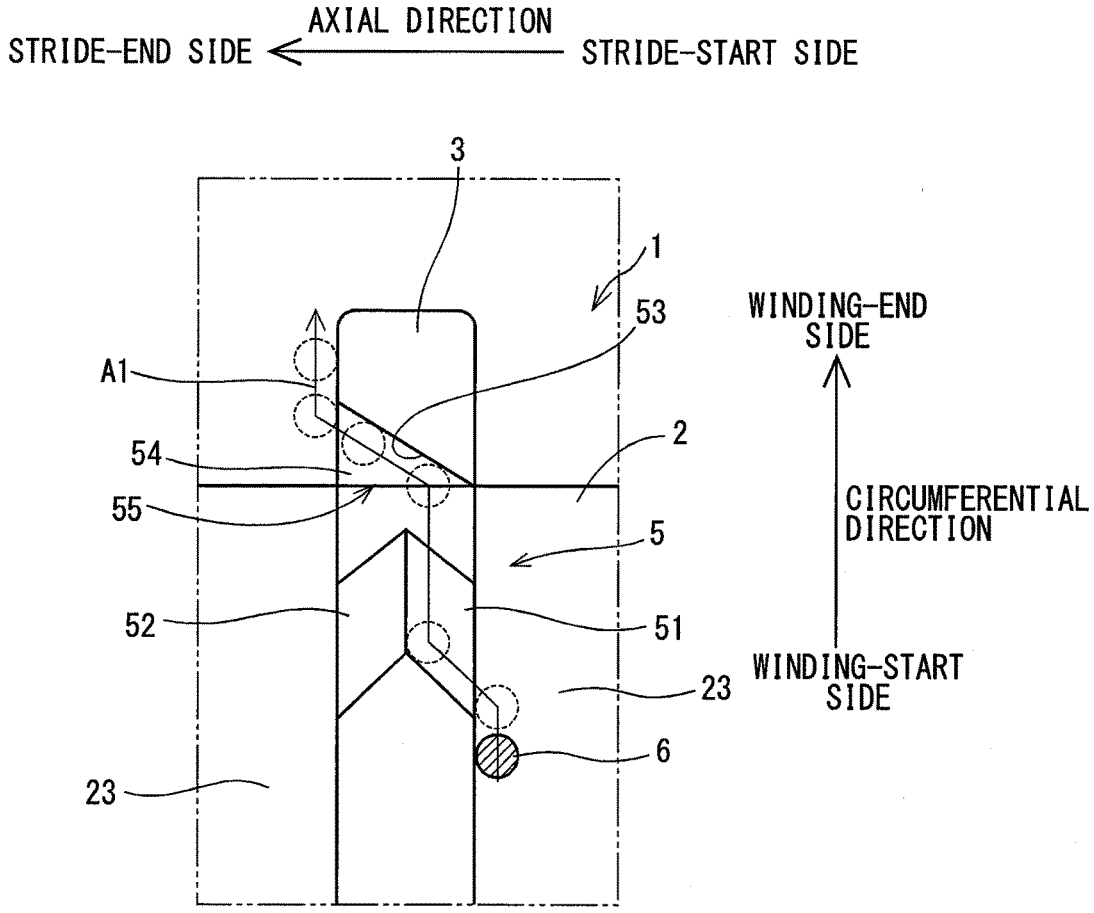
FIG. 3 is a schematic enlarged view showing a portion III of the bobbin surrounded by a two-dot-chain line in FIG. 1.

In FIG. 3, an arrow A1 indicates a pathway of the wire rod 6 striding over the inside partitioning wall 3 by passing through the groove 5.

As shown in FIG. 3, when the wire rode 6 passes through the groove 5, the wire rod 6 moves along the first guide wall surface 51, the second guide wall surface 53 and the third guide wall surface 54, not only in the circumferential direction from the winding-start side to the winding-end side but also in the axial direction from the stride-start side to the stride-end side. In other words, the wire rod 6 is guided by the first to the third guide wall surface 51, 52 and 53 in its moving direction (in the circumferential and the axial directions).

In addition, even when any force is applied to the wire rod 6, which is on away of passing through the groove 5, in a direction opposite to the moving direction of the wire rod 6, the wire rod 6 is brought into contact with the return prevention wall surface 52 and the wire rod 6 is thereby prevented from returning in the direction to the stride-start side.

(Winding Apparatus)

Figure 4:
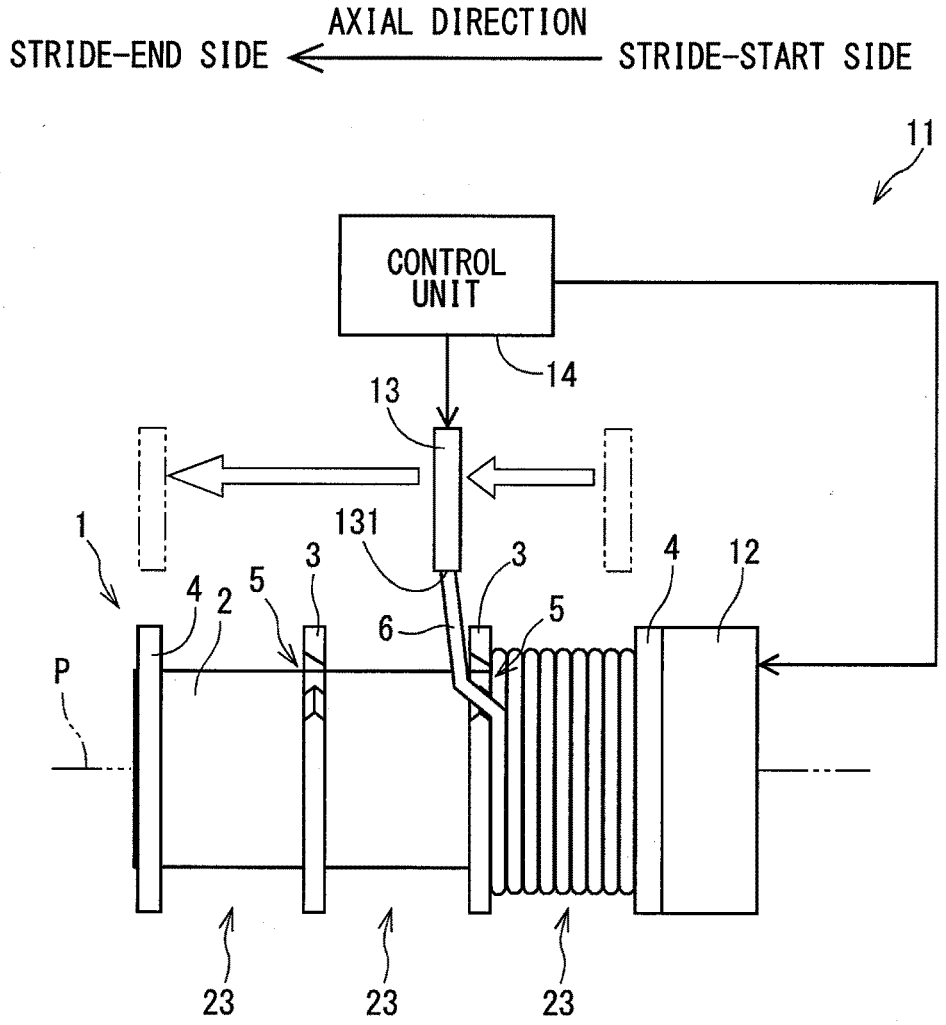
FIG. 4 is a schematic view showing a winding apparatus according to the first embodiment.

A structure of a winding apparatus 11 of the present embodiment will be explained with reference to FIGS. 4, 5A and 5B.

The winding apparatus 11 is an apparatus for manufacturing the split-winding type coil by winding the wire rod 6 on the bobbin 1. In the following explanation, the bobbin 1 in FIG. 4 has three winding areas 23 only for the purpose of explaining a winding process of the coil.

The winding apparatus 11 has a holding portion 12 for holding the bobbin 1, a nozzle portion 13 for supplying the wire rode 6, a control unit 14 and so on.

The holding portion 12 is rotatably supported in the winding apparatus 11, so that the holding portion 12 is rotated together with the bobbin 1 when the bobbin 1 is held by the holding portion 12 and the holding portion 12 is driven to rotate. The center axis P of the bobbin 1 is co-axial with a rotational center of the holding portion 12. In the following explanation, the axial direction of the bobbin 1 which is held by the holding portion 12 is simply referred to as the axial direction.

The nozzle portion 13 has a nozzle forward end 131, from which the wire rod 6 is supplied to the bobbin 1, wherein the wire rod 6 is supplied to the nozzle portion 13 from a supply source (not shown) of the wire rod 6. The nozzle portion 13 is movable relative to the bobbin 1 by, for example, a well-known traversing mechanism (not shown).

The control unit 14, which is composed of a microcomputer, controls a rotation of the bobbin 1, a reciprocal movement of the nozzle portion 13 and so on based on a relative position of the nozzle portion 13 to the bobbin 1.

The wire rod 6 to be supplied to the bobbin 1 is moved in the circumferential direction relative to the bobbin 1, when the bobbin 1 is rotated in a bobbin rotation direction. In addition, the wire rod 6 is moved in the axial direction relative to the bobbin 1, when the nozzle portion 13 is moved in the axial direction.

An operation of the winding apparatus 11 for manufacturing the split-winding type coil by using the bobbin 1 will be explained with reference to FIGS. 5 to 8.

The movements of the holding portion 12 and the nozzle portion 13 are controlled by the control unit 14. FIG. 5A is a graph showing a temporal change of a moving speed of the nozzle portion 13. FIG. 5B is a graph showing a temporal change of a rotational speed of the bobbin 1.

The winding apparatus 11 manufactures the split-winding type coil by winding the wire rod 6 in each of the winding areas 23 of the bobbin 1 to form a coil segment (having multiple coil layers) in each winding area 23.

When the coil segment is formed in an "nth" winding area 23, the holding portion 12 is rotated together with the bobbin 1 and the nozzle portion 13 is reciprocated in the axial direction above the "nth" winding area 23 while supplying the wire rod 6 to the bobbin 1. More exactly, the nozzle portion 13 is reciprocated in the axial direction above the "nth" winding area 23 during a period in which the wire rod 6 is wound on the bobbin 1 from a first coil layer to a last-but-one coil layer. When the wire rod 6 is wound in the "nth" winding area 23 of the bobbin 1 for a last coil layer, the nozzle portion 13 is moved in the "nth" winding area 23 in the axial direction from the stride-start side to the stride-end side. When the wire rod 6 is wound for a last winding turn of the last coil layer, the nozzle portion 13 is moved to a position directly above the inside partitioning wall 3.

Figure 6:
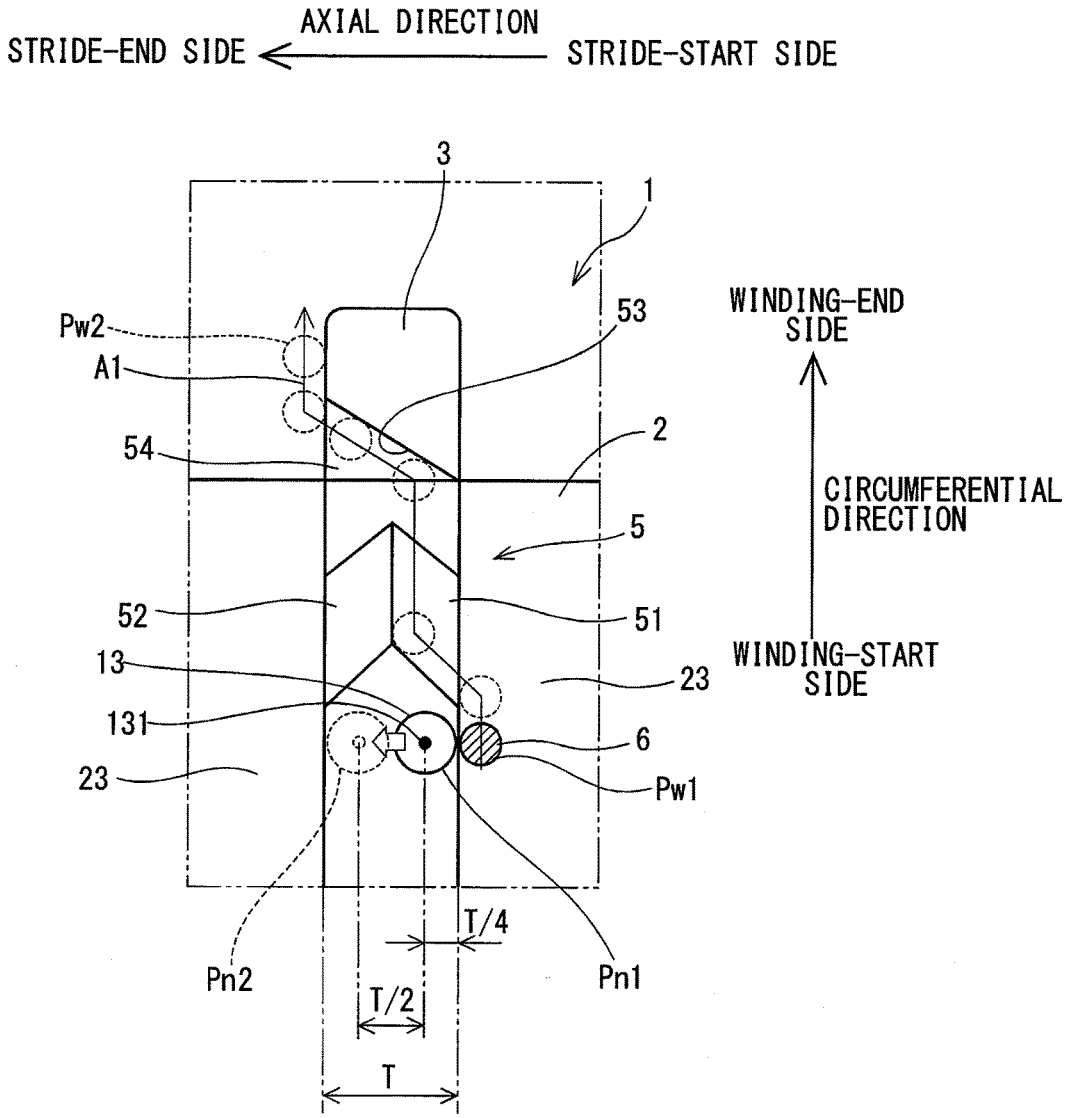
FIG. 6 is a schematic enlarged view showing a portion VI of the bobbin surrounded by the two-dot-chain line in FIG. 1, wherein the portion VI corresponds to the portion III
Figure 7:
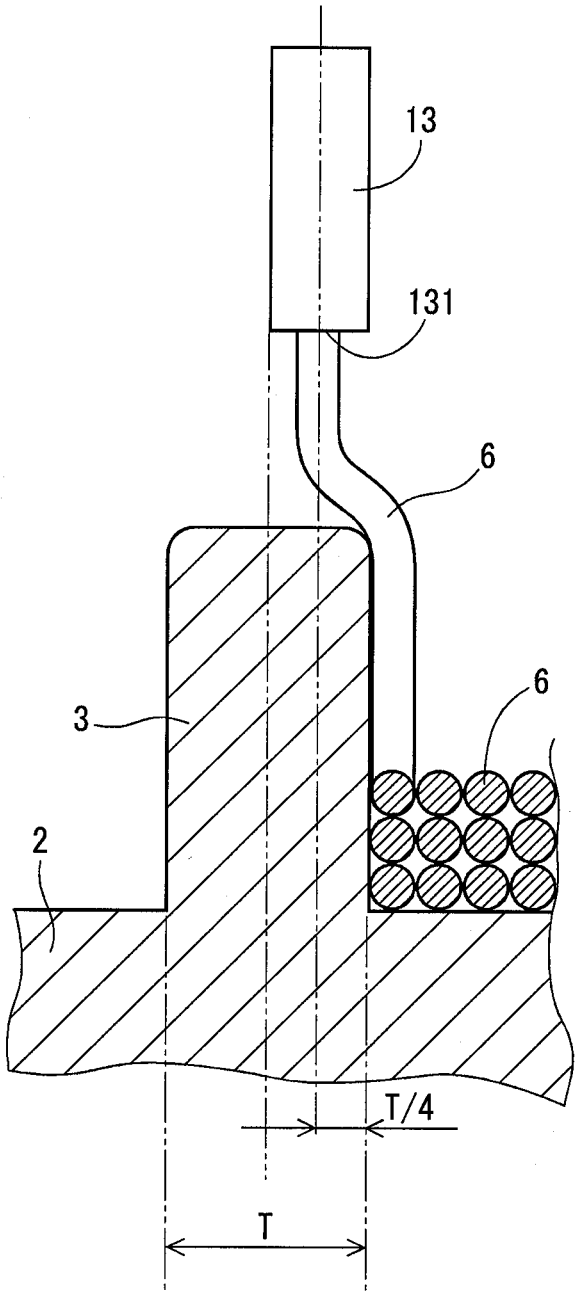
FIG. 7 is a schematic cross-sectional view showing a position of the nozzle portion and a condition of the wire rod immediately before the wire rod strides over a partitioning wall from one winding area to a neighboring winding area.

More exactly, as shown in FIG. 6, the nozzle portion 13 is moved in the axial direction to a first predetermined position Pn1, which is located at a position distanced from an axial end surface (a right-hand end surface in the drawing) of the inside partitioning wall 3 for the "nth" winding area 23 by an amount of a quarter (¼) of a width T of the inside partitioning wall 3. During a process, in which the nozzle portion 13 is moved to the first predetermined position Pn1, the wire rod 6 is pulled into the groove 5 in the direction from the "nth" winding area 23 to the inside partitioning wall 3, while the wire rod 6 is wound on the bobbin 1 for the "nth" winding area 23, as shown in FIG. 7.

Figure 5A:
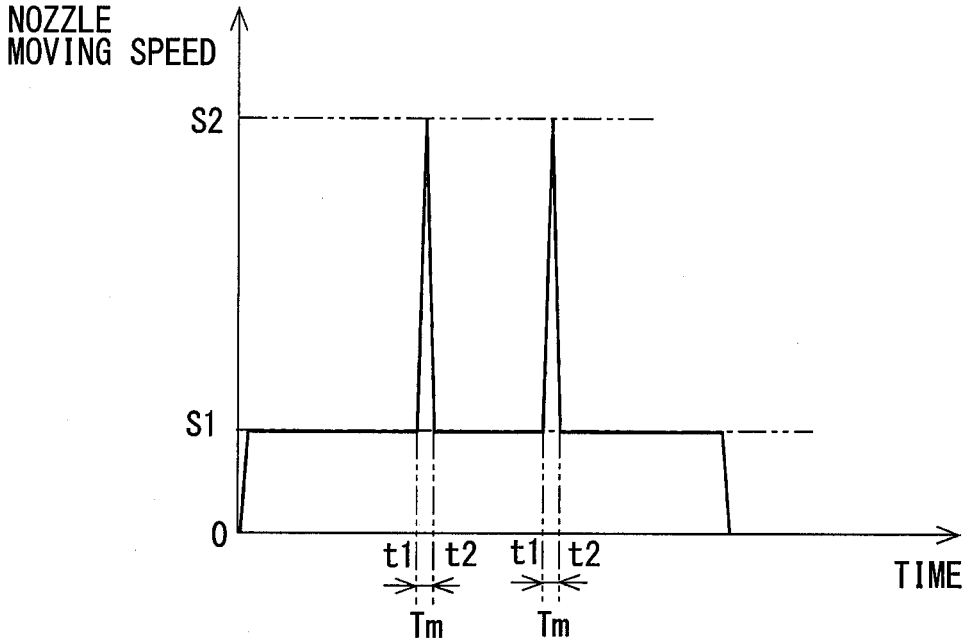
FIG. 5A is a graph showing a change of a nozzle moving speed with respect to a time.
Figure 5B:
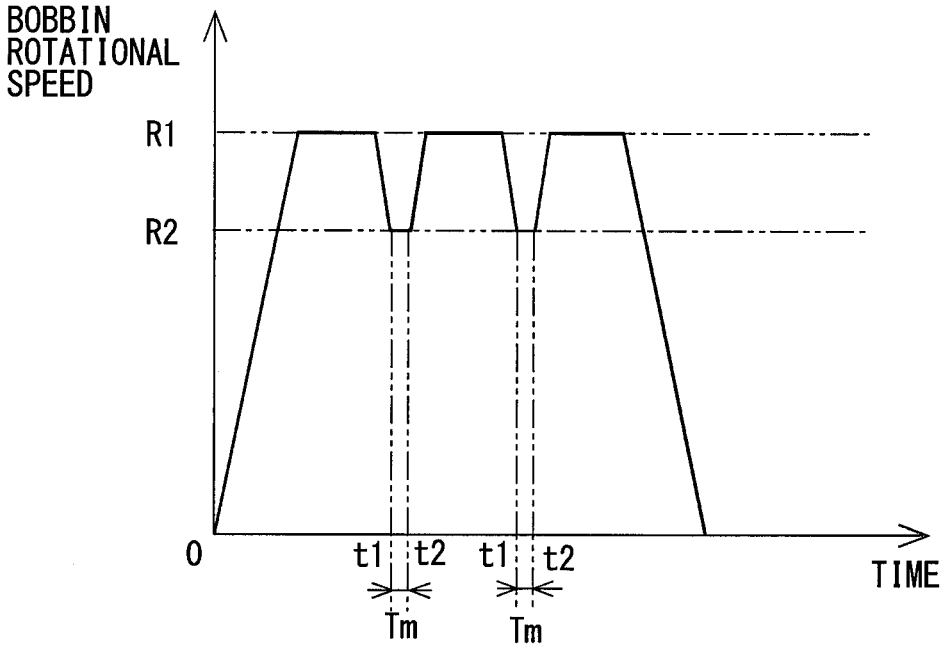
FIG. 5B is a graph showing a change of a bobbin rotational speed with respect to a time.

A timing, at which the winding process for the last winding turn of the last coil layer is terminated, in other words, a timing, at which the wire rod 6 is wound in the "nth" winding area 23 of the bobbin 1 by predetermined winding turns, is indicated by "t1" in FIGS. 5A and 5B.

During the winding process in which the wire rod 6 is wound in the "nth" winding area 23, the moving speed of the nozzle portion 13 is controlled at a first speed S1. The rotational speed of the bobbin 1 is maintained at a value of R1 (a first rotational speed R1) and then reduced to a value of R2 (a second rotational speed R2) toward the timing t1 (an end of the winding process for the "nth" winding area 23).

The first and the second rotational speeds R1 and R2 may be larger than, but not limited to, 10,000 rpm. The second rotational speed R2 is preferably a value of 60 to 70% of the first rotational speed R1.

When the nozzle portion 13 reaches the first predetermined position Pn1 at the timing t1, the nozzle portion 13 is immediately moved to a second predetermined position Pn2, which is further distanced in the axial direction to the stride-end side from the first predetermined position Pn1 by a half (½) of the width T of the inside partitioning wall 3. In other words, the second predetermined position Pn2 corresponds to a position above the inside partitioning wall 3, which is distanced from the axial end surface (the right-hand end surface in the drawing) of the inside partitioning wall 3 for the "nth" winding area 23 by an amount of three quarters (¾) of the width T of the inside partitioning wall 3.

The immediate movement of the nozzle portion 13 from the first predetermined position Pn1 to the second predetermined position Pn2 is terminated at a timing t2. A time period between the timing t1 and the timing t2 is referred to as a transit period Tm.

The transit period Tm is set at a value, which is shorter than a time required for one rotation of the bobbin 1 at the second rotational speed R2. During the transit period Tm, the moving speed of the nozzle portion 13 is accelerated from the first speed S1 to a second speed S2 (S2>S1), and then the moving speed is decelerated from the second speed S2 to the first speed S1, in order that the immediate movement of the nozzle portion 13 is carried out.

Figure 8A:
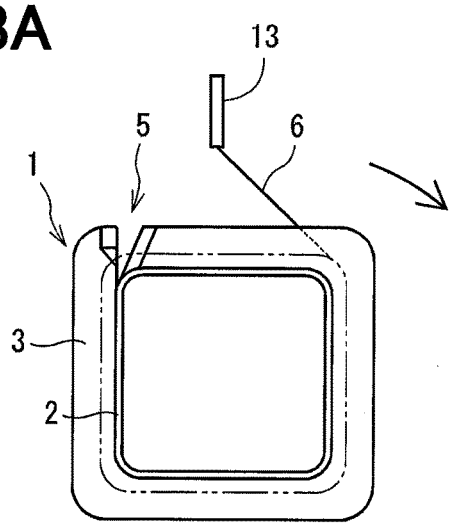
FIGS. 8A to 8C are schematic cross-sectional views of the bobbin for explaining a rotating condition of the bobbin in a stride-over period of the wire rod.
Figure 8B:
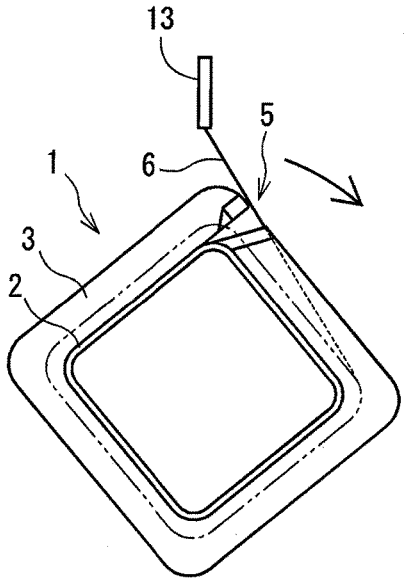
Figure 8C:
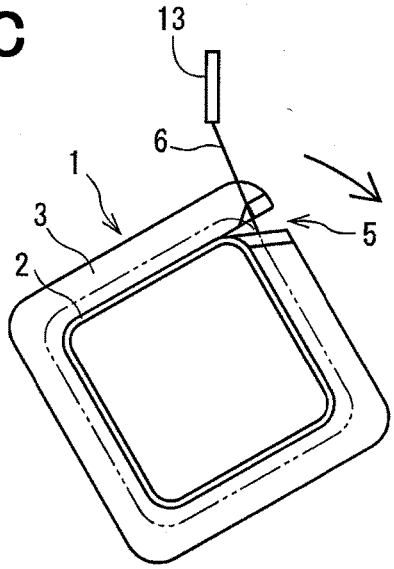

Each of FIGS. 8A to 8C shows a condition in which the bobbin 1 is rotated during the transit period Tm. In a case that a rotational angle of the bobbin 1 at the timing t1 (that is, at a start of the transit period Tm, for example, a rotational position of the bobbin 1 as shown in FIG. 8A) is regarded as zero, the wire rod 6 passes through the groove 5 when the rotational angle of the bobbin 1 becomes about 60 degrees at the timing t2 (that is, the end of the transit period Tm, a rotational position of the bobbin 1 as shown in FIG. 8C).

According to the above operation of the winding apparatus 11, as shown in FIG. 6, the wire rod 6 to be supplied to the bobbin 1 can move from a first position Pw1 to a second position Pw2 along a line indicated by the arrow A1 within a short time period of the transit period Tm. Therefore, the wire rod 6 can surely and quickly pass through the groove 5.

After the timing t2, the nozzle portion 13 is moved to a position above a "(n+1)th" winding area 23 at the first speed S1 and reciprocated in the axial direction above the "(n+1)th" winding area 23. The wire rod 6 is wound on the bobbin 1 for the "(n+1)th" winding area 23. When the wire rod 6 is wound on the bobbin 1 for a first winding turn of a first coil layer, the wire rod 6 is pulled in the direction to the inside partitioning wall 3 (that is, in a direction to the "nth" winding area 23).

In addition, the rotational speed of the bobbin 1 is increased to the first rotational speed R1 after the timing t2.

When the above operation is repeated, the wire rod 6 is wound for all of the winding areas 23 of the bobbin 1 with the predetermined winding turns, to thereby form the split-winding type coil.

(Advantages)

Advantages of the first embodiment will be explained hereinafter.

Figure 11:
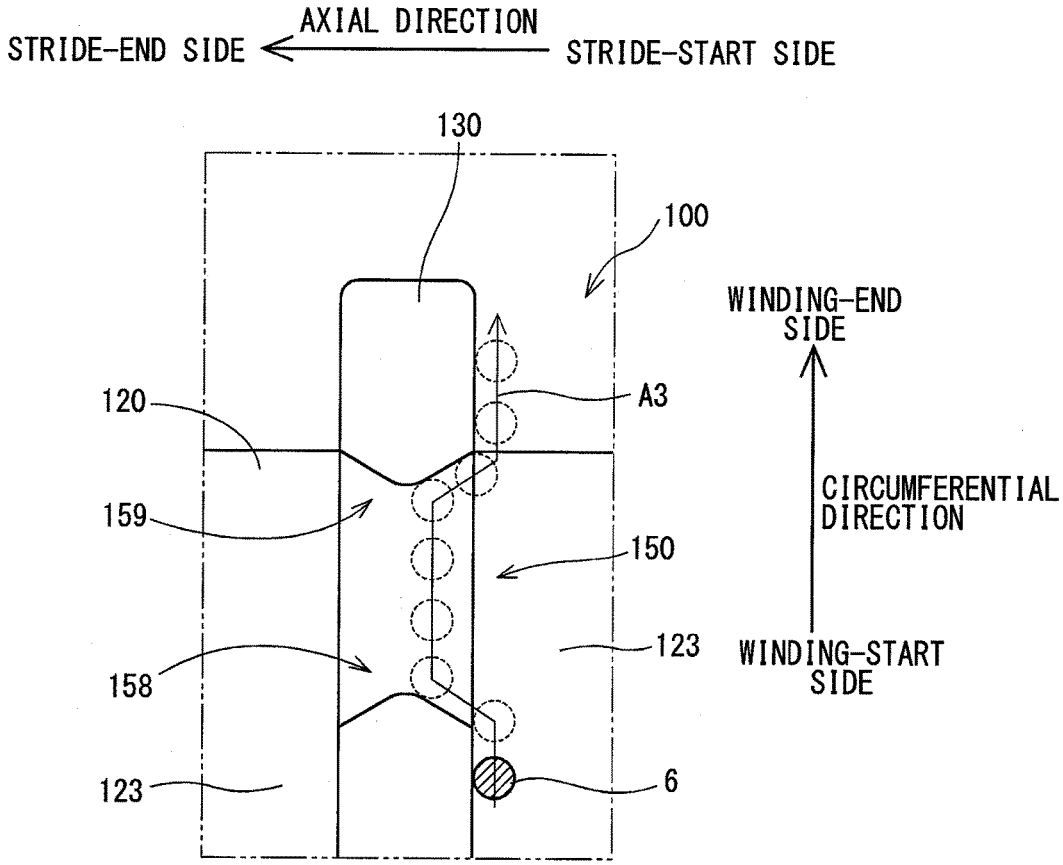
FIG. 11 is a schematic enlarged view showing a portion of a bobbin according to a comparison example.

At first, a bobbin 100 of a comparison example will be explained with reference to FIG. 11.

In a similar manner to the first embodiment, the bobbin 100 has a winding core 120 and multiple partitioning walls 130. A structure of a groove 150 formed in the partitioning wall 130 is different from that of the first embodiment. The groove 150 is formed by a first wall surface 158 facing to the winding-end side and a second wall surface 159 facing to the winding-start side. Each of the wall surfaces 158 and 159 is formed in a mound shape and opposed to each other in the circumferential direction, so that the first and the second wall surfaces 158 and 159 are in a condition of a mirror image.

When the wire rod 6 is wound on the bobbin 100, the wire rod 6 cannot pass through the groove 150 if the bobbin 100 is rotated at a high speed. For example, as indicated by an arrow A3, even when the wire rod 6 enters the groove 150 along the first wall surface 158 of the groove 150, the wire rod 6 is brought into contact with the second wall surface 159 and the wire rod 6 is thereby moved along the second wall surface 159 in the direction to the stride-start side. In other words, the wire rod 6 may return to a winding area 123 of the stride-start side.

Therefore, in a winding apparatus for the bobbin 100, a rotational speed of the bobbin 100 is decreased to almost zero in order that the wire rod 6 can pass through the groove 150. It is, therefore, necessary to repeat the decrease (the decrease to almost zero) and increase of the rotational speed of the bobbin 100, when the wire rod 6 is wound on the bobbin 100 for all of its winding areas 123. As a result, it requires time.

According to the present embodiment, however, the bobbin 1 has;

the winding core 2 on which the wire rod 6 is wound in the circumferential direction; and the multiple inside partitioning walls 3, which are formed at the outer peripheral surface 21 of the winding core 2 in order to define the multiple winding areas 23, wherein the multiple inside partitioning walls 3 are arranged in the axial direction so as to divide the winding space around the outer peripheral surface 21 into the multiple winding areas 23 arranged in the axial direction, and wherein the groove 5 is formed in each of the inside partitioning walls 3 so that the wire rod 6 passes through the groove 5 from one of the winding areas 23 to the neighboring winding area 23.

In addition, the groove 5 has the first guide wall surface 51 and the second guide wall surface 53, which are opposed to each other in the circumferential direction. Each of the guide wall surfaces 51 and 53 is inclined toward the winding-end side of the circumferential direction, in the axial direction to the stride-end side.

When the wire rod 6 is wound on the bobbin 1, the wire rod 6 is moved relative to the winding core 2 in the circumferential direction from the winding-start side to the winding-end side and in the axial direction from the stride-start side to the stride-end side (or vice versa), so as to form the multiple coil layers in each of the winding areas 23. When the winding process for one of the winding areas 23 is completed, the wire rod 6 passes through the groove 5 from the one winding area 23 to the neighboring winding area 23.

According to the above structure of the bobbin 1, each of the first and the second guide wall surface 51 and 53 are opposed to each other in the circumferential direction and extends in the axial direction to the stride-end side. As a result, the wire rod 6 is guided in the direction to the inside of the groove 5 when the wire rod 6 is moved along the first guide wall surface 51, while the wire rod 6 is guided in the direction to the outside of the groove 5 when the wire rod 6 is moved along the second guide wall surface 53. Accordingly, the wire rod 6 can surely pass through the groove 5 from one winding area 23 to the other winding area 23.

Therefore, in the case of winding the wire rod 6 on the bobbin 1, the wire rod 6 can pass through the groove 5 even when the bobbin 1 is rotated at the high speed. In other words, it is not necessary to decrease the rotational speed of the bobbin 1 to almost zero, each time when the wire rod 6 passes through the groove 5 from one winding area 23 to the other winding area 23.

In the present disclosure, the high speed for the rotational speed of the bobbin 1 may be a value higher than 10,000 rpm (but not limited thereto).

Figure 12:
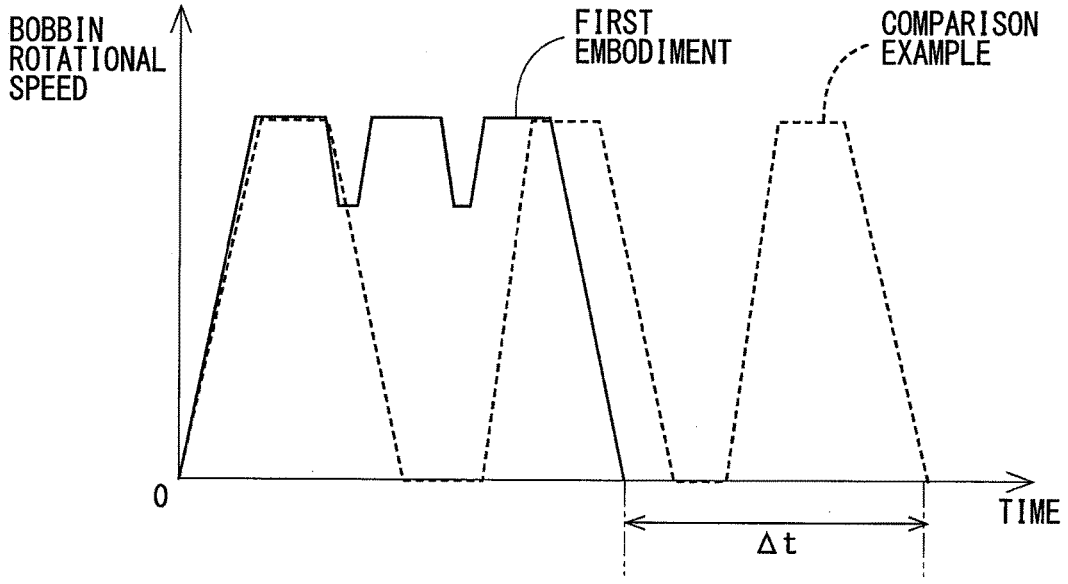
FIG. 12 is a graph showing the bobbin rotational speed for comparing the first embodiment of the present disclosure with the comparison example.

FIG. 12 is a graph showing variations of the rotational speed of the bobbin 1 of the first embodiment and the bobbin 100 of the comparison example.

As shown in FIG. 12, a time required for winding the wire rod 6 on the bobbin 1 for all of the winding areas 23 in the first embodiment is shorter than that of the comparison example by $\Delta t$.

The winding apparatus 11 of the first embodiment is a winding apparatus for winding the wire rod 6 on the bobbin 1 for the split-winding type coil. The winding apparatus 11 has;

the holding portion 12 for holding the bobbin 1 and rotating together with the bobbin 1;

the nozzle portion 13 for supplying the wire rod 6 to the bobbin 1 and movable in the axial direction relative to the bobbin 1; and the control unit 14 for controlling the movement of the nozzle portion 13 with respect to the bobbin 1, wherein the moving speed of the nozzle portion 13 is accelerated and then decelerated when the nozzle portion 13 is moved in the axial direction from the first predetermined position Pn1 to the second predetermined position Pn2 during the time period in which the bobbin 1 is rotated by one revolution, wherein the first and the second predetermined positions Pn1 and Pn2 are located above the inside partitioning wall 3 (that is, within an axial space corresponding to the width of the inside partitioning wall 3).

According to the above winding apparatus 11, the wire rod 6 can surely and smoothly pass through the groove 5, when the wire rod 6 is wound on the bobbin 1.

In addition, according to the bobbin 1 and the winding apparatus 11 of the first embodiment, it is possible to avoid such a situation that the wire rod 6 strides over the outer peripheral surface 31 of the inside partitioning wall 3 without passing through the groove 5. As a result, it is possible to surely insulate the coil segment in one of the winding areas 23 from the coil segment in the neighboring winding area 23.

Second Embodiment

A bobbin 7 according to a second embodiment of the present disclosure will be explained with reference to FIGS. 9 and 10.

An inside partitioning wall 33 of the second embodiment has a groove 8, which is cut into the inside partitioning wall 33 from an outer peripheral surface 331 thereof until a forward end of the groove 8 reaches the outer peripheral surface 21 of the winding core 2. The inside partitioning wall 33 further has a cutout portion 9, which is formed at an axial end side of the inside partitioning wall 33 on the stride-start side.

The groove 8 has a first guide wall surface 81, a second guide wall surface 83, a third guide wall surface 84, a side wall surface 85 and so on.

Figure 10A:
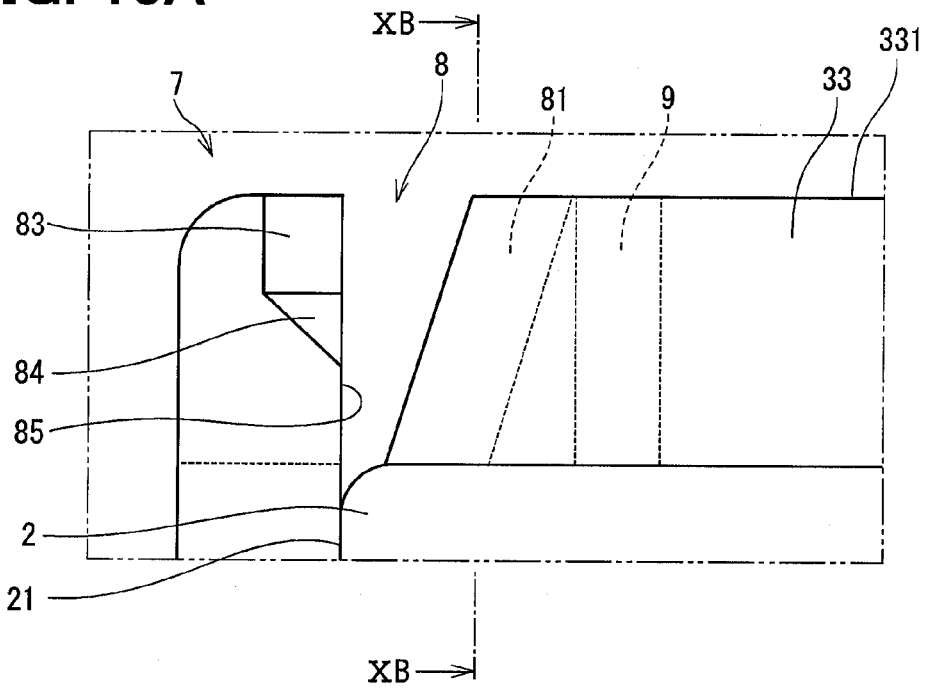
FIG. 10A is a schematic enlarged side view when viewed the bobbin in a direction XA in FIG. 9.
Figure 10B:
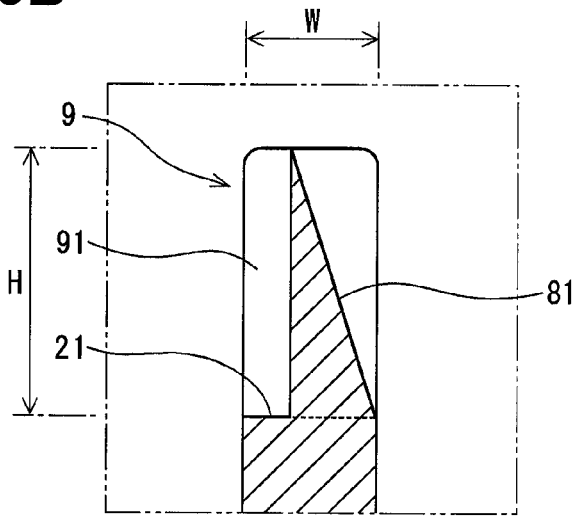
FIG. 10B is a schematic cross-sectional view taken along a line XB-XB in FIG. 10A.

The cutout portion 9 is formed by cutting out a portion of the inside partitioning wall 33 in a height direction of the inside partitioning wall 33 (that is, an up-and-down direction in FIGS. 10A and 10B) from the outer peripheral surface 331 of the inside partitioning wall 33 to the outer peripheral surface 21 of the winding core 2, so that the cutout portion 9 has a width "W" in the axial direction and a height "H" as shown in FIG. 10B. The cutout portion 9 has a side wall surface 91, which is inclined in the axial direction in such a way that the side wall surface 91 comes closer to the winding-end side in the axial direction to the stride-end side.

Figure 9:
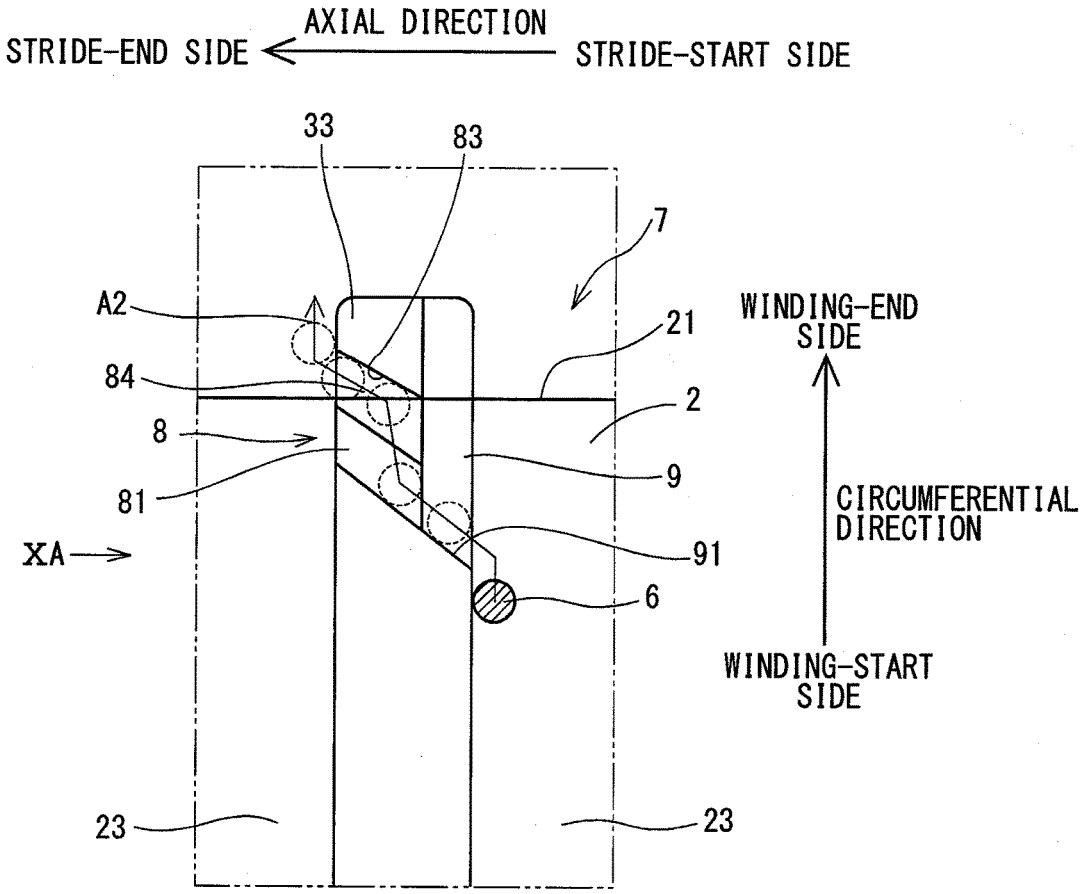
FIG. 9 is a schematic enlarged view showing a portion of a bobbin according to a second embodiment of the present disclosure.

In FIG. 9, an arrow A2 indicates a pathway of the wire rod 6 passing through the groove 8.

As shown in FIG. 9, the wire rod 6 is guided by the side wall surface 91 of the cutout portion 9 so as to move in the axial and circumferential direction along the side wall surface 91 and then the wire rod 6 passes through the groove 8. According to the second embodiment, it becomes easier for the wire rod 6 to enter the groove 8, because of the cutout portion 9. In the same manner to the first embodiment, the wire rod 6 is further guide by the first to the third guide wall surfaces 81, 82 and 83 in the wire-rod moving direction, in order that the wire rod 6 can surely pass through the groove 8.

In the second embodiment, the winding apparatus for the bobbin 7 and the winding process for the wire rod 6 are identical to those of the first embodiment.

Further Embodiments and/or Modifications

In the above first embodiment, the first predetermined position Pn1 for the nozzle portion 13 is located at the position distanced from the axial end surface of the inside partitioning wall 3 (that is, from the winding area 23) in the axial direction to the stride-end side by the quarter (¼) of the width T of the inside partitioning wall 3. The second position Pn2 of the nozzle portion 13 is located at the position further distanced in the axial direction to the stride-end side from the first predetermined position Pn1 by the half (½) of the width T of the inside partitioning wall 3.

However, the first and the second predetermined positions Pn1 and Pn2 are not limited to the above positions and may be located at any optional positions above the inside partitioning wall 3 (that is, within the axial space corresponding to the width of the inside partitioning wall 3).

The present disclosure is not limited to the above embodiments and/or modifications but can be modified in various manners without departing from a spirit of the present disclosure.

What is claimed is:

1. A bobbin of a split-winding type comprising:

a winding core on which a wire rod is wound in a circumferential direction of the winding core;

multiple partitioning walls formed at an outer peripheral surface of the winding core in such a manner that each of the partitioning walls extends in a radial-outward direction, the partitioning walls being arranged in an axial direction of the winding core so as to define multiple winding areas arranged in the axial direction of the winding core; and a groove having a V-shape formed in each of the partitioning walls, through which the wire rod passes from a first winding area to a second winding area neighboring to the first winding area, wherein the groove has a first guide wall surface and a second guide wall surface, which are opposed to each other in the circumferential direction, wherein the first guide wall surface is inclined in the axial direction with respect to the first winding area and directly faces the first winding area, the second guide wall surface is inclined in the axial direction with respect to the second winding area and directly faces the second winding area, wherein the first guide wall surface is inclined in the circumferential direction such that the first guide surface comes closer to the second guide wall surface in the circumferential direction from a winding-start side to a winding-end side and the first guide surface comes closer to the second guide wall surface in the axial direction from a stride-start side to a stride-end side, and wherein the second guide wall surface extends in the circumferential direction such that the second guide surface goes away from the first guide wall surface in the axial direction from the stride-start side to the stride-end side.

2. The bobbin according to claim 1, wherein the groove has a return prevention wall surface, which is inclined in the axial direction such that the return prevention wall surface comes closer to the winding-end side of the circumferential direction in the axial direction to a stride-start side, and the return prevention wall surface forms a mound shape surface together with the first guide wall surface.

3. The bobbin according to claim 1, wherein the groove has a cutout portion, which is formed at an axial end side of the partitioning wall on a side opposite to the groove in the axial direction.

4. A winding apparatus for winding the wire rod on the bobbin according to claim 1, comprising:

a holding portion for holding the bobbin and rotating together with the bobbin;

a nozzle portion for supplying the wire rod to the bobbin and movable in the axial direction relative to the bobbin; and a control unit for controlling a movement of the nozzle portion in such a manner that a moving speed of the nozzle portion is accelerated and then decelerated when the nozzle portion moves in the axial direction from a first predetermined position to a second predetermined position, during a period in which the bobbin is rotated by one revolution, when the wire rod passes through the groove from one of the winding areas to the neighboring winding area, wherein each of the first and the second predetermined positions is located at a position above the partitioning wall.

5. The winding apparatus according to claim 4, wherein the wire rod is wound on the bobbin in each of the winding areas by a predetermined number of winding turns, and the control unit moves the nozzle portion from the winding area to the first predetermined position, when the bobbin is rotated and when the wire rod is wound on the bobbin for a last winding turn of a predetermined number of the winding turns for the winding area.

6. A split-winding type coil comprising:

the bobbin according to claim 1; and the wire rod wound on the bobbin for each of the winding areas.

7. A bobbin of a split-winding type comprising:

a winding core on which a wire rod is wound in a circumferential direction of the winding core;

multiple partitioning walls formed at an outer peripheral surface of the winding core in such a manner that each of the partitioning walls extends in a radial-outward direction, the partitioning walls being arranged in an axial direction of the winding core so as to define multiple winding areas arranged in the axial direction of the winding core; and a groove having a V-shape formed in each of the partitioning walls, through which the wire rod passes from a first winding area to a second winding area neighboring to the first winding area, wherein the groove has a first guide wall surface and a second guide wall surface, which are opposed to each other in the circumferential direction, wherein the first guide wall surface is inclined in the axial direction with respect to the first winding area and directly faces the first winding area, the second guide wall surface is inclined in the axial direction with respect to the second winding area and directly faces the second winding area, and wherein the first guide wall surface is inwardly inclined in the circumferential direction such that the first guide surface comes closer to the second guide wall surface in the circumferential direction from a winding-start side to a winding-end side and the first guide surface comes closer to the second guide wall surface in the axial direction from a stride-start side to a stride-end side.

8. The bobbin according to claim 7, wherein each of the first and the second guide wall surface has a width in the axial direction of the bobbin, the width of the second guide wall surface is larger than that of the first guide wall surface, so that the second guide wall surface is opposed to an entire portion of the first guide wall surface in the circumferential direction.

* * * * *